US007571961B2

(12) United States Patent
Gold et al.

(10) Patent No.: US 7,571,961 B2
(45) **Date of Patent: *Aug. 11, 2009**

(54) PORTABLE BOOSTER SEAT

(75) Inventors: Katherine Gold, Denver, CO (US); Lynn Rosen, Parker, CO (US)

(73) Assignee: Gold Bug, Inc., Aurora, CO (US)

( * ) Notice: Subject to any disclaimer, the term of this patent is extended or adjusted under 35 U.S.C. 154(b) by 3 days.

This patent is subject to a terminal disclaimer.

(21) Appl. No.: 12/152,716

(22) Filed: May 16, 2008

(65) Prior Publication Data

US 2008/0217973 A1 Sep. 11, 2008

Related U.S. Application Data

(63) Continuation-in-part of application No. 11/490,366, filed on Jul. 20, 2006, now Pat. No. 7,374,241.

(51) Int. Cl.

| | |
|---|---|
| ***A47D 1/10*** | (2006.01) |
| ***A47D 1/02*** | (2006.01) |
| ***A47D 15/00*** | (2006.01) |
| ***A52B 35/00*** | (2006.01) |

(52) U.S. Cl. ..... 297/255; 297/250.1; 297/17; 297/440.1; 297/440.15; 297/485

(58) Field of Classification Search ..... 297/255, 297/250.1, 17, 440.1, 440.15, 485
See application file for complete search history.

(56) References Cited

U.S. PATENT DOCUMENTS

| | | | | |
|---|---|---|---|---|
| 1,569,045 | A | 1/1926 | Sommer | |
| 2,237,057 | A | 4/1941 | Meyer | |
| 2,979,121 | A | 4/1961 | Gates | |
| 3,121,588 | A | 2/1964 | Beckman et al. | |
| 4,527,830 | A | 7/1985 | Meyers | |
| 4,842,329 | A | 6/1989 | Owens | |
| 4,871,210 | A | 10/1989 | Alexander et al. | |
| 5,123,699 | A | 6/1992 | Warburton | |
| 5,335,968 | A | 8/1994 | Sheridan et al. | |
| 5,354,121 | A | 10/1994 | Allum | |
| 5,469,592 | A | 11/1995 | Johnson | |
| 5,499,860 | A | 3/1996 | Smith et al. | |
| 5,913,571 | A | 6/1999 | Dystra et al. | |
| 6,079,772 | A | 6/2000 | Green | |
| 6,390,345 | B1 | 5/2002 | Brown et al. | |
| 6,402,251 | B1 | 6/2002 | Stoll | |
| 6,616,242 | B1 | 9/2003 | Stoll | |
| 6,692,072 | B2 | 2/2004 | Nelson et al. | |
| 6,907,842 | B2 | 6/2005 | Godshaw | |
| 6,932,429 | B2 | 8/2005 | Kamiki | |
| 6,969,120 | B2 | 11/2005 | Levin | |
| 7,000,985 | B2 | 2/2006 | Belgarde | |
| 7,021,719 | B2 | 4/2006 | Stoll | |
| 7,073,866 | B1 | 7/2006 | Berdahl | |
| 7,140,692 | B2 | 11/2006 | Stoll | |
| 7,374,241 | B2 * | 5/2008 | Gold et al. | 297/255 |
| 7,422,276 | B2 * | 9/2008 | Flannery | 297/255 X |
| 7,438,356 | B2 * | 10/2008 | Howman et al. | 297/17 X |

* cited by examiner

*Primary Examiner*—Rodney B White
(74) *Attorney, Agent, or Firm*—The Reilly Intellectual Property Law Firm, P.C.; Ellen Reilly

(57) ABSTRACT

A portable infant booster seat having an upright back support, foldable sidewalls, a flexible front wall and an upwardly extendible cushioned seat member that supports an infant in an elevated seated position.

24 Claims, 9 Drawing Sheets

PORTABLE BOOSTER SEAT

CROSS-REFERENCE TO RELATED APPLICATIONS

The present application is a continuation-in-part of patent application Ser. No. 11/490,366, filed 20 Jul. 2006 now U.S. Pat. No. 7,374,241, for PORTABLE BOOSTER SEAT, by Katherine Gold and Lynn Rosen and assigned to the assignee of this invention and incorporated by reference herein.

BACKGROUND AND FIELD

An article of manufacture relating generally to a foldable seat and more particularly to a portable infant booster seat which is compact and easy to handle but affords maximum support for an infant.

Infant booster seats are well known in the prior art. Portable booster seats have become more popular due to the concern about sharing germs between booster seat users and the lack of booster seats in some locations. The present infant booster seat has an upright back support, foldable sidewalls and a flexible front wall forming an outer shell. A seat member hingedly connected to the outer shell includes a cushioned seat and support panels that extend from a lower front edge and mid-section of the seat, providing a unitary support structure for the seat. The seat member may be placed in a horizontal position for use with an infant or in a compact, upright, folded storage position. The following embodiments and aspects thereof are described and illustrated in conjunction with systems which are meant to be exemplary and illustrative, not limiting in scope.

SUMMARY

The embodiments set forth are exemplary and not for purposes of limitation. The present embodiments are designed to provide a novel and improved portable infant booster seat that may be placed on any surface including an adult chair or the like. The present booster provides an elevated, rugged seat with firm lateral support for an infant. Additionally, the present booster seat is foldable and easily portable as well as easy to store. Due to the flexibility of the booster seat, it may be folded into a compact unit without having separate attachment pieces.

In accordance with the present article of manufacture, there is provided a foldable seat assembly having an outer shell including a back support, sidewalls and a bottom member, also having a cushioned seat member with at least one hinged support member between the sidewalls and spanning a width of an underside of the seat member, the cushioned seat member resting upon the hinged support panel when in an unfolded, use position, the cushioned seat member hingedly connected by a hinge member to the upright back support, and the sidewalls extending forwardly from and hingedly connected to the back support along opposite sides of the seat member. The hinged support member includes a plurality of support panels hingedly connected to the seat member and located between upper and lower platforms. The support panels are movable between a folded position and an unfolded position extending perpendicular to the seat member. The back support forms a part of a unitary shell which includes the sidewalls, a front wall and a bottom panel member.

In addition to the article of manufacture described above, there is provided a method of supporting an infant in a booster seat assembly, the seat assembly having a rigid, upright back support, foldable sidewalls connected to the back support, a cushioned seat member having at least one hinged support panel thereunder, the seat member hingedly connected to said back support, the method comprising the steps of unfolding the sidewalls from a position overlapping one another and the seat member to a position extending along opposite sides of the seat member, adjusting the front wall to form a seat housing, lowering the seat member into a horizontal position between and supported by the sidewalls, seating an infant on the seat member, and securing the infant to the seat member with child restraints. Further aspects and embodiments will become apparent by reference to the drawings and by study of the following descriptions. Exemplary embodiments are illustrated in reference to Figures of the drawings. It is intended that the embodiments and Figures disclosed herein are to be considered illustrative rather than limiting.

DETAILED DESCRIPTION

Figure 1:
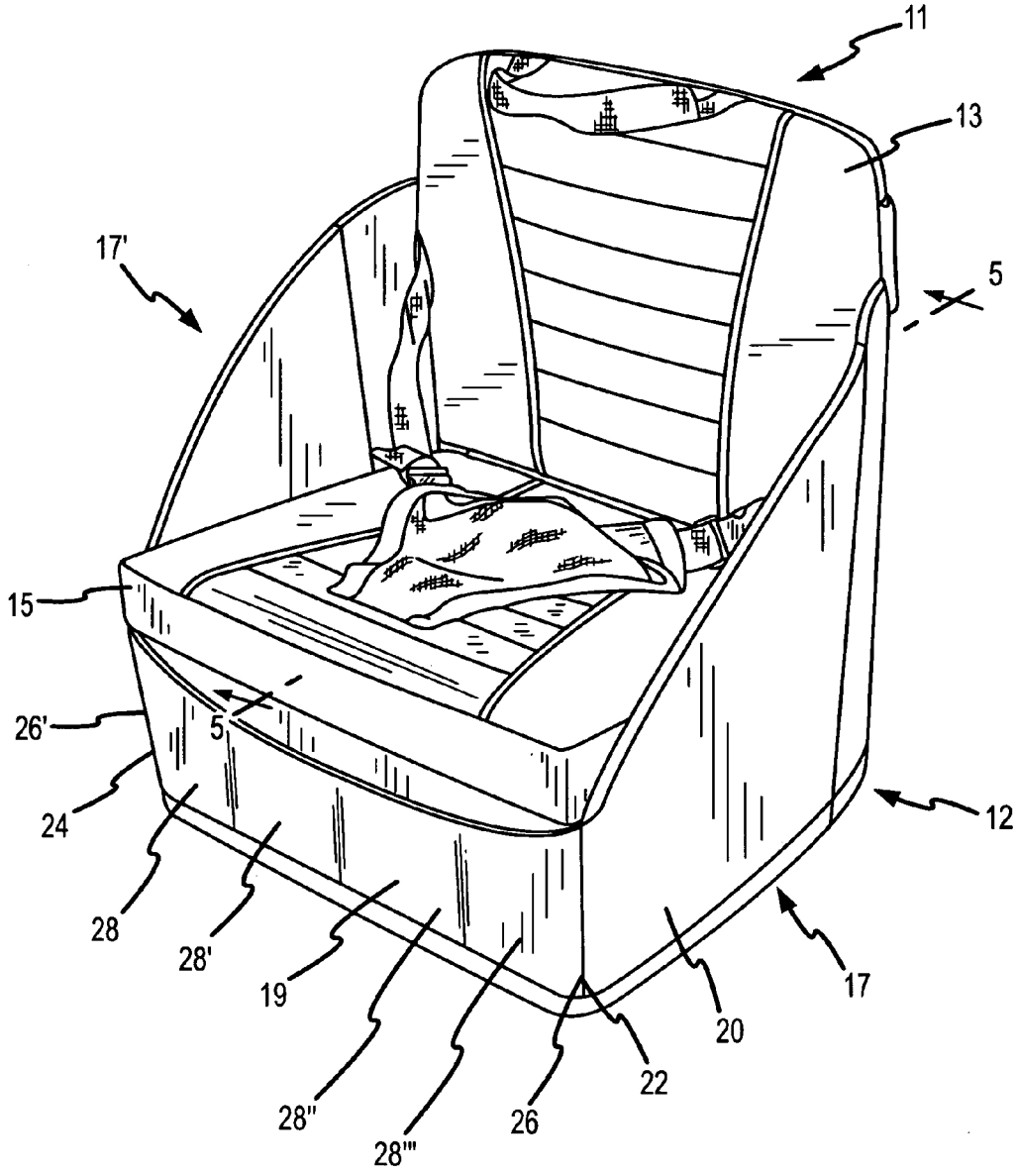
FIG. 1 is a perspective view of a portable infant booster seat.
Figure 3:
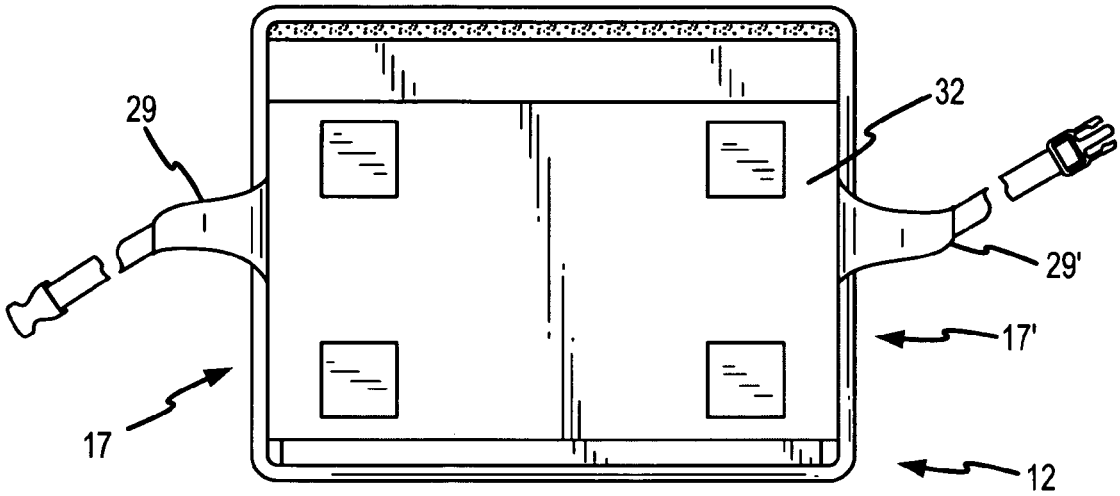
FIG. 3 is a bottom view of the portable infant booster seat shown in FIG. 1.
Figure 4:
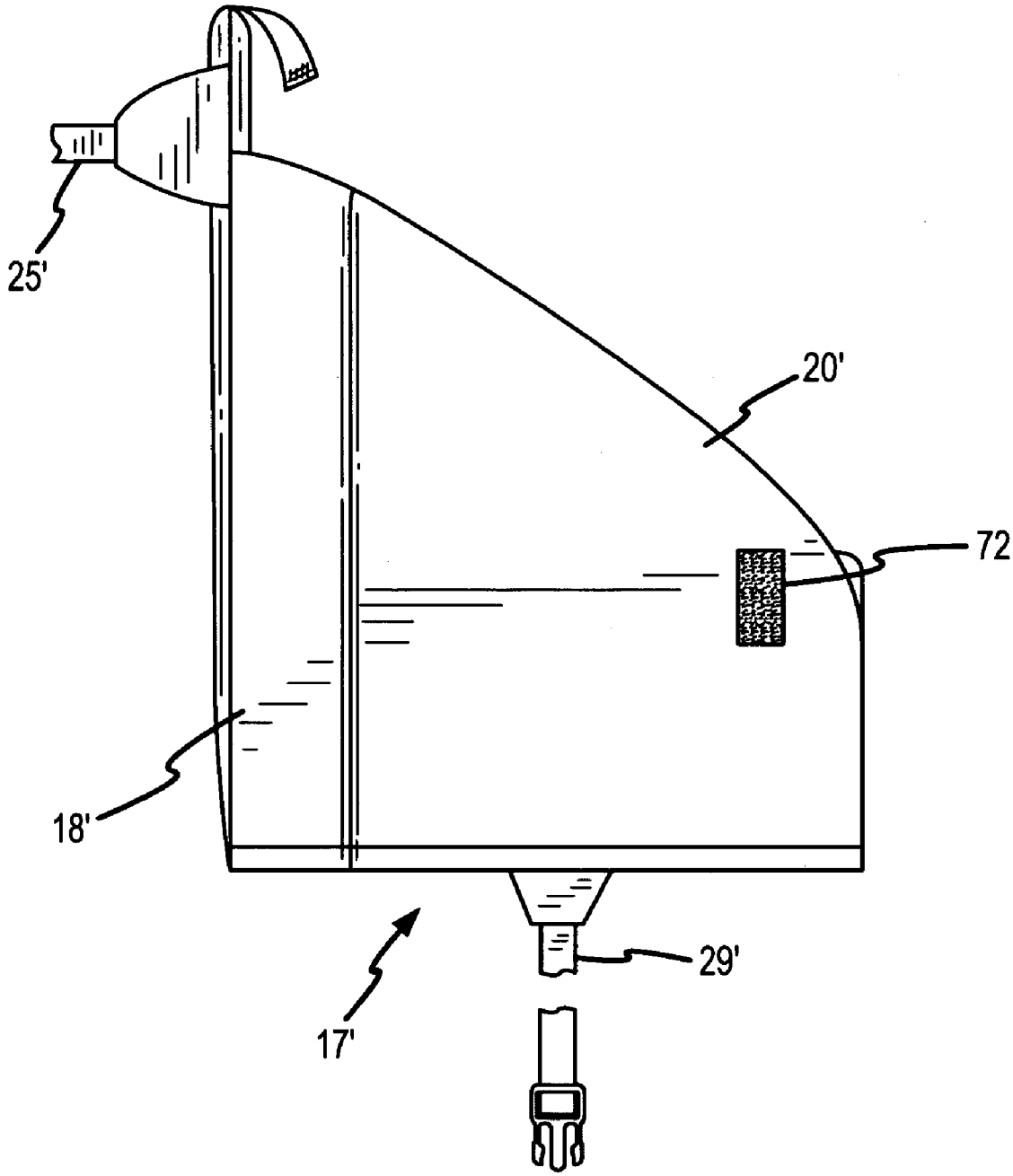
FIG. 4 is a side view of the portable infant booster seat according to FIG. 1.
Figure 5:
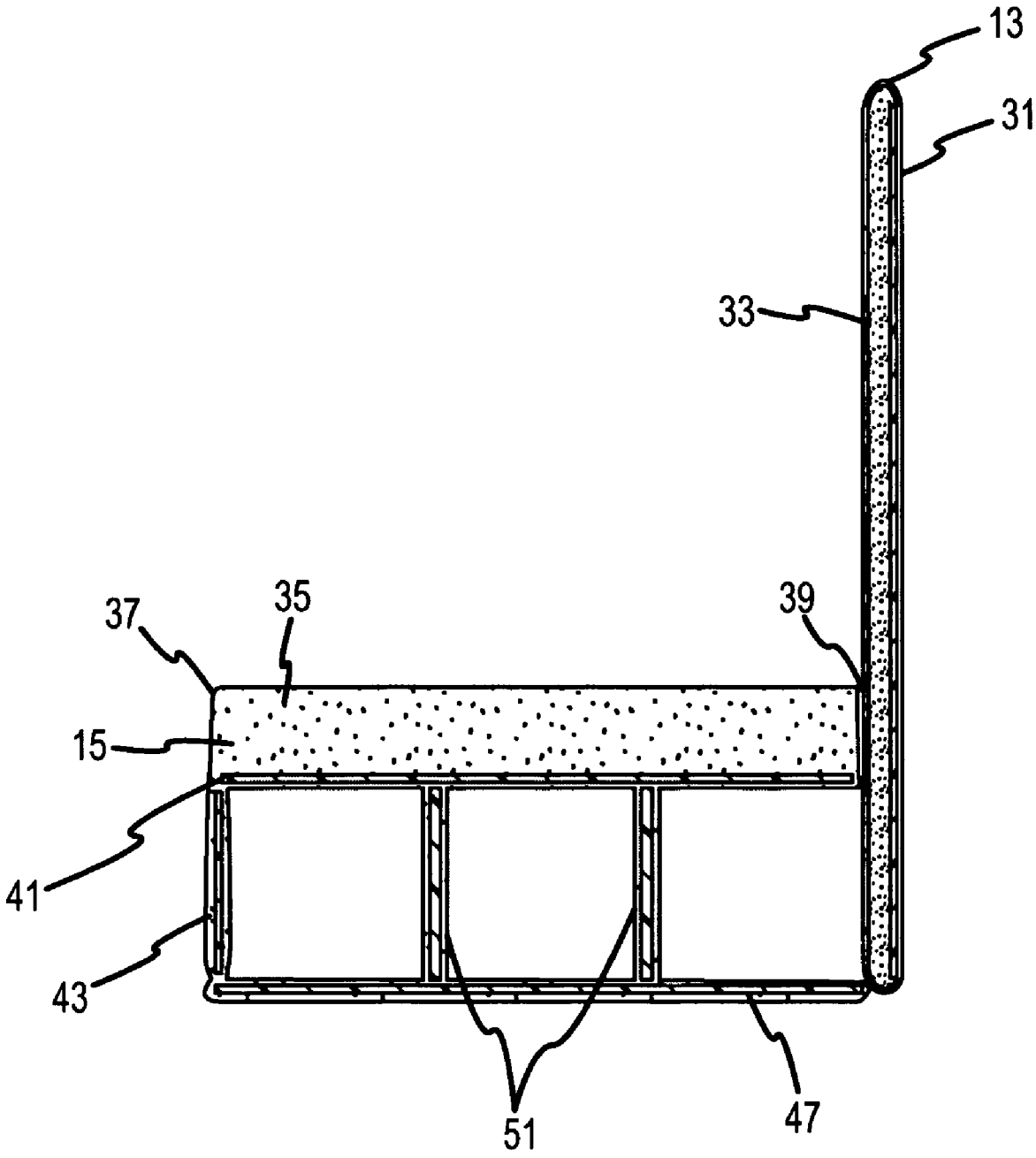
FIG. 5 is a side cross-sectional view taken about lines 5-5 of FIG. 1.
Figure 6:
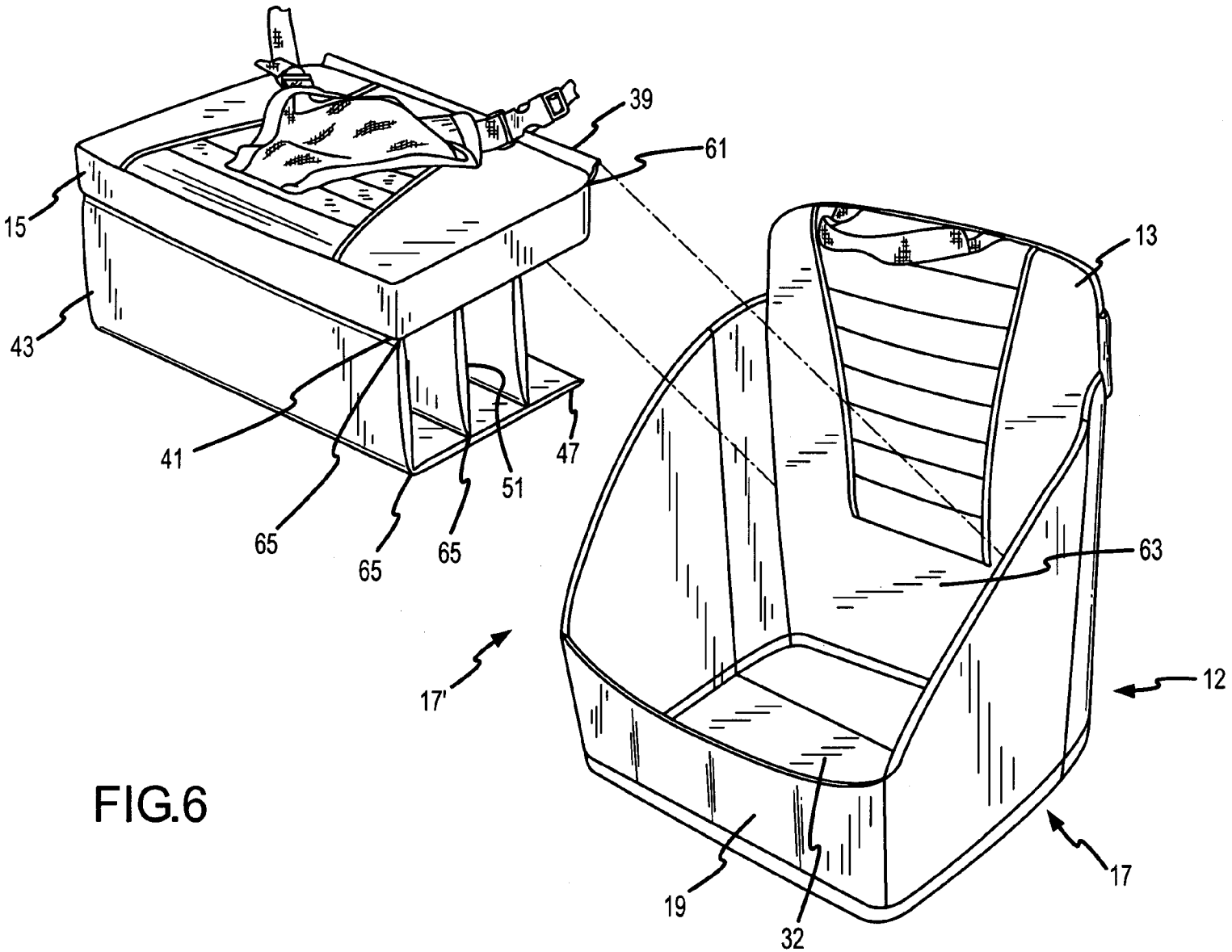
FIG. 6 is an exploded perspective view of the portable infant booster seat of FIG. 1.
Figure 7:
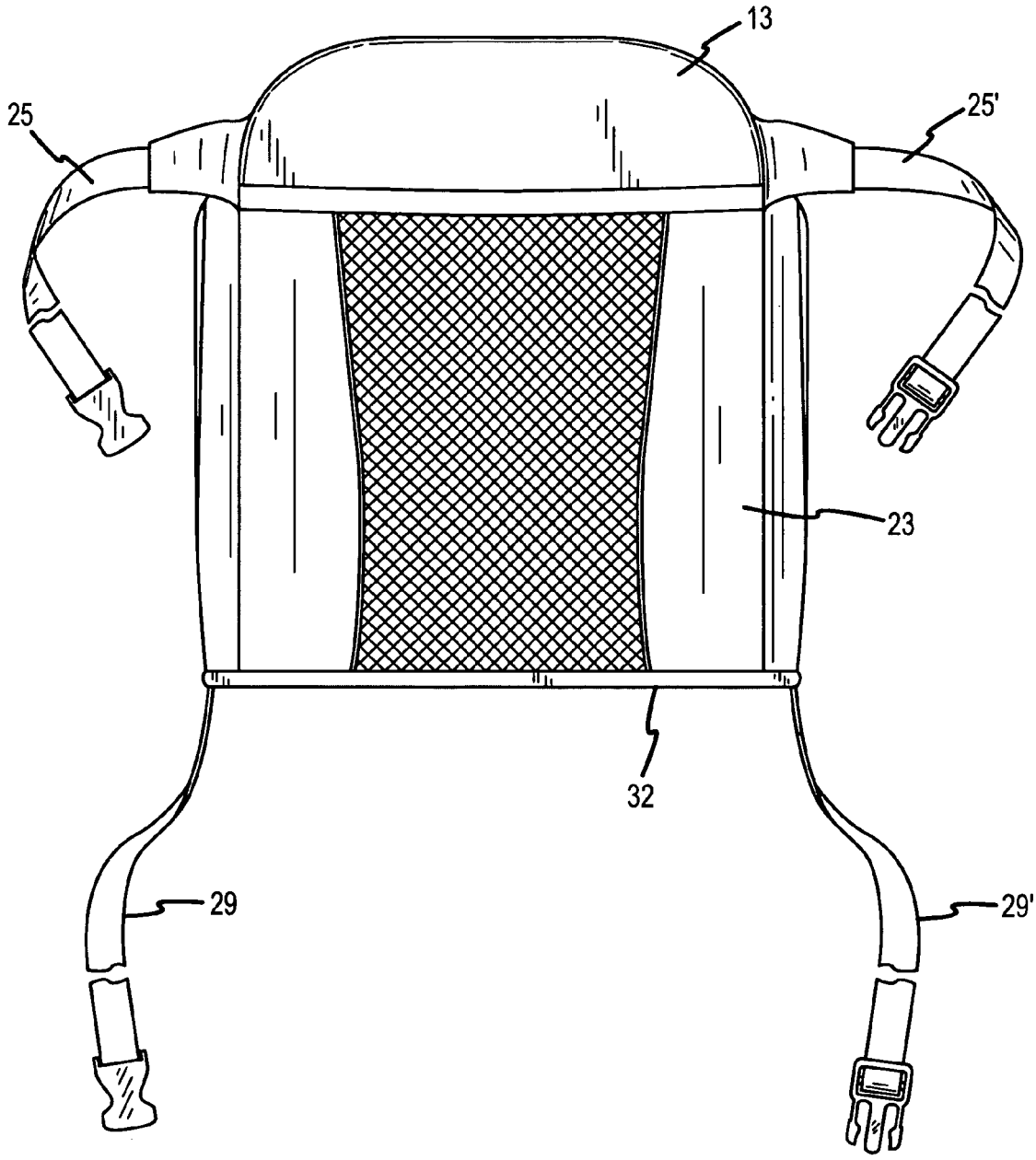
FIG. 7 is a rear view of the portable infant booster seat according to 1.
Figure 8:
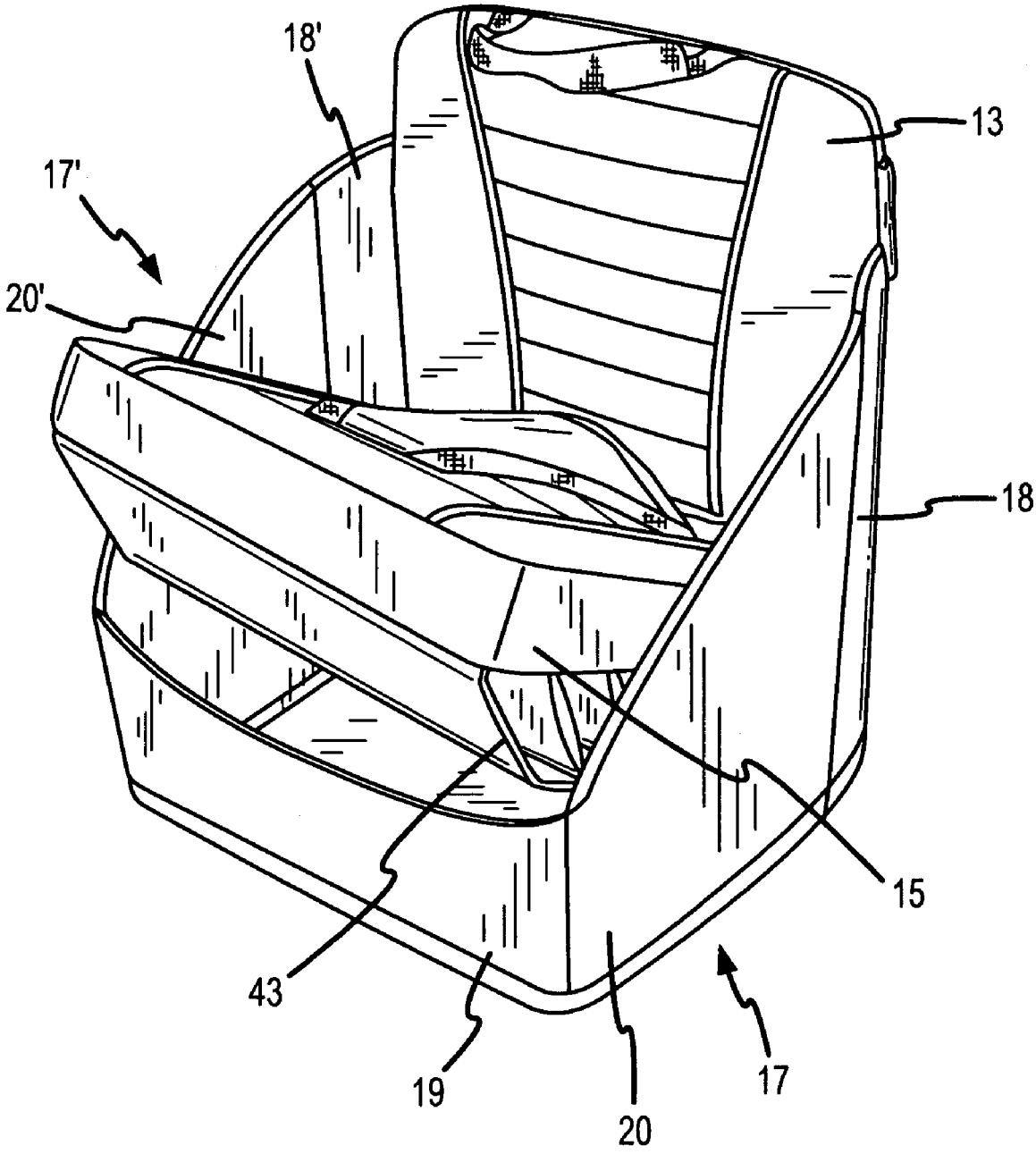
FIG. 8 is a side perspective view of the portable infant booster seat shown in FIG. 1.
Figure 9:
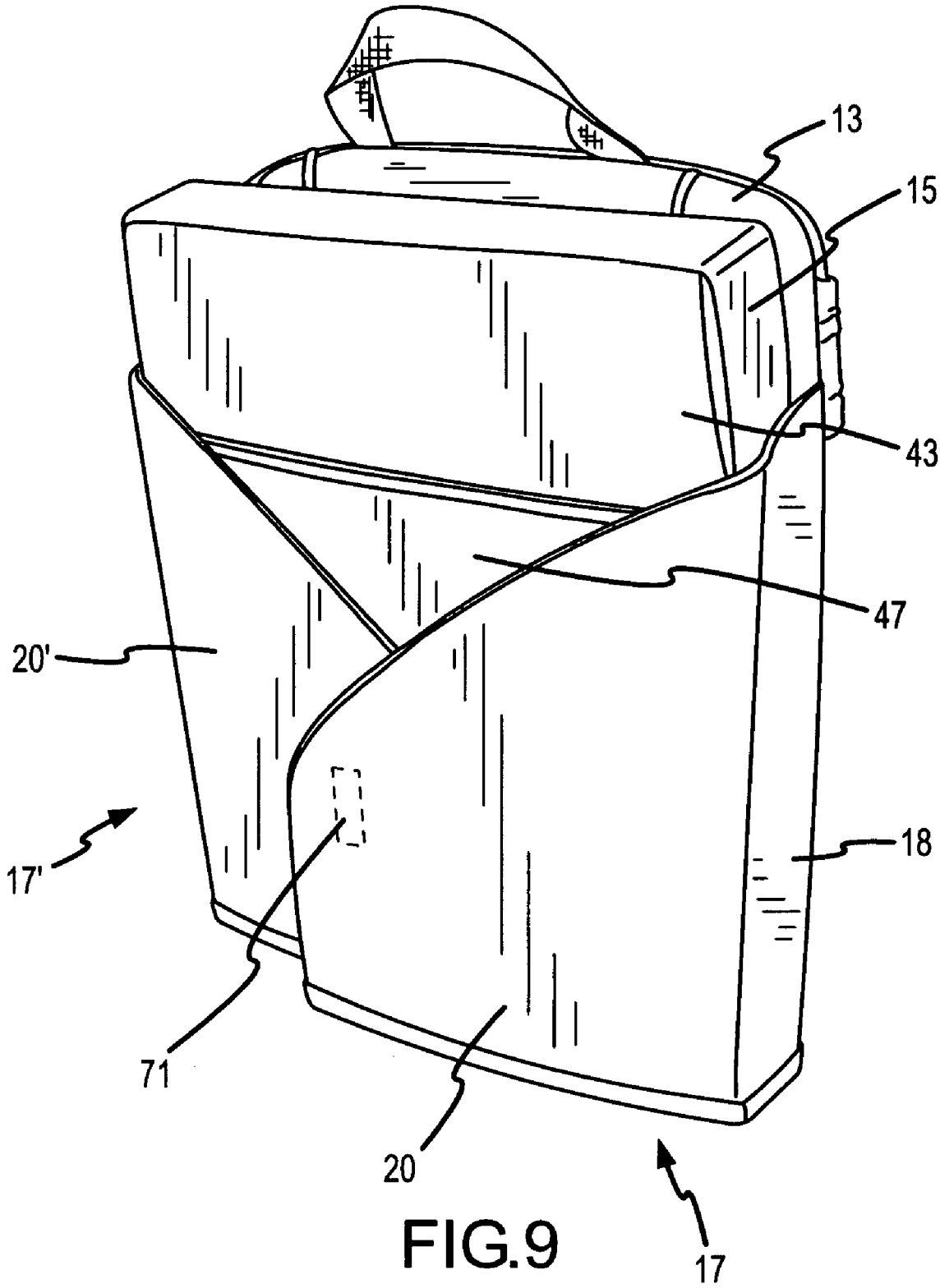
FIG. 9 is a perspective view of the portable infant booster seat of FIG. 1.
Figure 10:
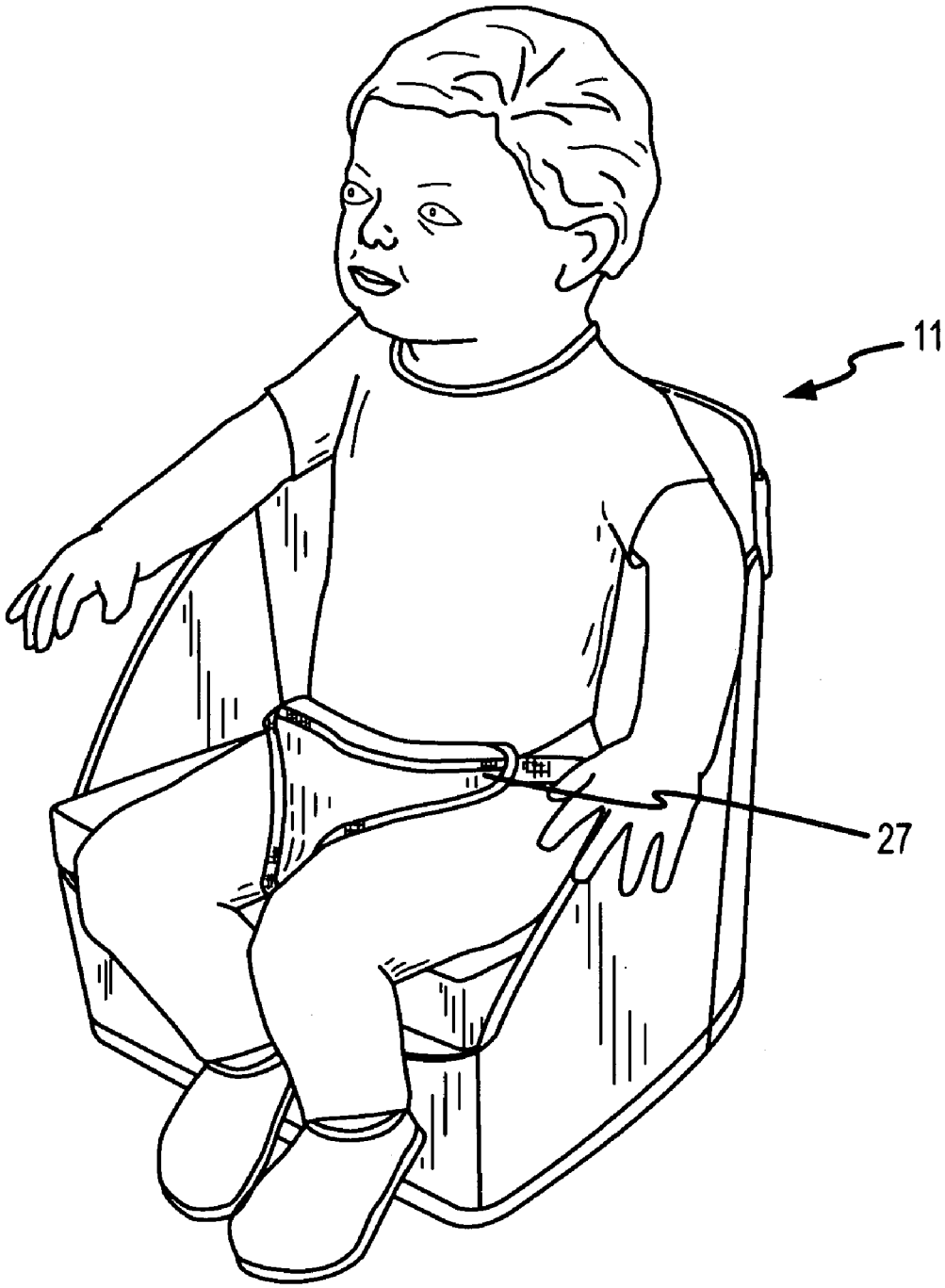
FIG. 10 is a perspective view of the portable infant booster seat of FIG. 1 including an infant seated therein.

Referring to FIGS. 1 through 10, there is shown a portable infant booster seat assembly 11 comprising an outer shell 12 of unitary construction made up of an upright back support or back member 13, foldable sidewalls 17, 17' that extend forwardly from opposite sides of the back support 13 into a flexible front wall 19 and a unitary bottom panel 32. The booster seat assembly has a cushioned seat member 15 that is in hinged relation to the back support 13 as shown in FIGS. 6 and 8. The seat member 15 may be placed in a first horizontal position as shown in FIGS. 1 and 10 and may also be placed in a second vertical position as shown in FIG. 9 wherein the seat member 15 is extended upwardly into flush engagement with the back support 13. Referring to FIG. 5, the seat member 15 is a unitary structure that in one embodiment has a solid or rigid base member 41 with foam padding 35 or any other type of material that provides a measure of resiliency and comfort. The cushion 35, in one embodiment, is approximately 2" in thickness and covered with a seat cover 37 made of nylon or water repellant fabric in order to prevent undue staining. The base member 41 is a platform in the form of a flat, rigid board to which the cushion 35 is secured. The platform 41 rests upon a front platform support or panel 43, at least one mid-section platform support 51 and a lower platform base 47. The front and mid-section platform supports, 43 and 51, are hingedly connected at opposite ends to the upper and lower platforms 41 and 47. The hinged connections 65 are shown in FIG. 6. The platform supports 43 and 51 in this embodiment are panel sections spanning the width of an underside of the seat member as shown in FIGS. 5 and 6. These are shown by way of example and not limitation; the supports 43 and 51 may also be defined by rods or posts at spaced intervals under the seat cushion for supportive elevation of the seat. Further, the platform supports 43 and 51 are not limited to panel sections of a certain width. Further, additional platform supports 51, as shown in FIG. 5, may be added to provide extra support. The platform 41 is parallel with the lower platform base 47 and perpendicular or angled with respect to the midsection platform supports 51 and the front support member 43 when the seat member 15 is in the first horizontal position. The front platform support 43 and the mid-section platform supports 51 are aligned parallel to the seat platform 41 and the platform base 47 when the seat member is in the storage or vertical position. This is shown in FIGS. 8 and 9. The cushioned seat member 15 has a built in support structure, as described above, providing for elevation and support of the base member 41 and the cushion 35.

The outer shell 12 which is shown in FIG. 6 includes the upright back support 13, the sidewalls 17, 17', the foldable front wall 19 and the bottom panel 32. The outer shell 12 is a unitary structure that provides upright and lateral support for an infant as well as support for the seat member. Referring to FIG. 3, the bottom panel 32 spans the entire width of the outer shell 12 but extends only partially along a length of the foldable sidewalls 17, 17'.

Referring to FIG. 5, the back support 13 includes a rigid support member 31 and a pad or cushion 33 superimposed on the rigid member 31. Referring to FIGS. 8 and 9, the sidewalls 17, 17' include first narrow panel members 18, 18' fixed to opposite sides of the back support 13, and second foldable panel members 20, 20' which are foldable about the front edges of the members 18, 18' to permit inward folding of the sidewalls. The panel members 18, 18', 20, 20' each include a rigid member (not shown) with a cushion or pad (not shown) superimposed along a surface similar to the back rest member 13. Referring to FIG. 6, the back support 13, the bottom platform 47 and hinge member 39 limit movement of the seat member 15 between the horizontal position and the upwardly extending or vertical position in flush engagement with the back support 13. The hinge member 39, in this embodiment comprising a vinyl strip or in a further embodiment defined by sewing an edge 61 of the seat member 15 to a lower portion 63 of the back support 13, forms a connection point between the seat member 15 and the back support 13. The sidewalls 17, 17' include the pair of foldable support members 18, 18' and 20, 20' for rigidifying the sidewalls 17, 17' and allowing for positioning of the sidewalls 17, 17' in a folded position as shown in FIG. 9. The sidewalls 17, 17' can be of varying degrees of stiffness and are not limited to the pair of foldable members 18, 18' and 20, 20'. The collapsible front wall 19 is connected along opposite lateral edges 22 and 24 to forwardly extending edges 26, 26' of the side panels 20, 20'. The front wall 19 is defined by a number of foldable panel members 28, 28', 28'', 28''', and may also have varying degrees of stiffness. These panel members provide reinforcement along the front wall 19 when the seat member 15 is hinged in the horizontal position while also allowing for easy folding when the seat member assembly is in the compact storage position.

Figure 2:
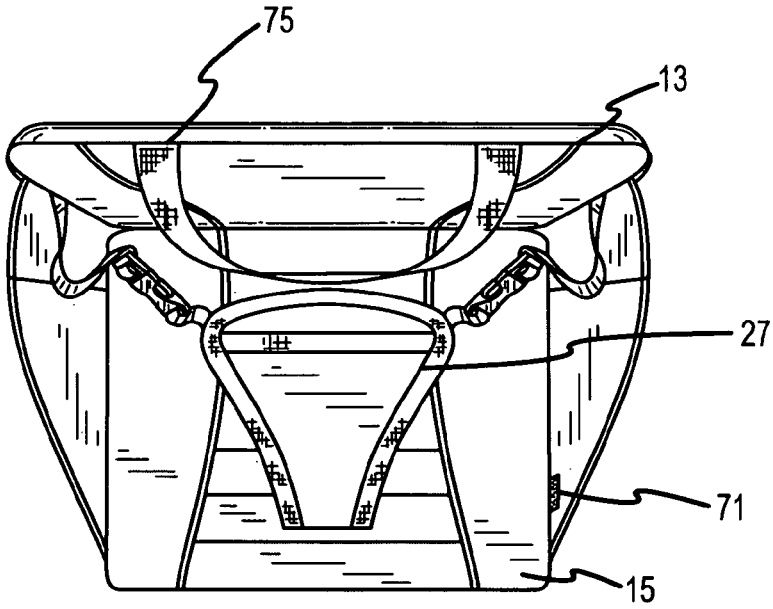
FIG. 2 is a top view according to FIG. 1.

The outer shell 12, the seat member 15 including the platform and platform supports 41, 43, 47 and 51, are completely covered with a vinyl or stain-resistant cover 37. The upright back support 13 includes a rear pocket member 23 as shown in FIG. 7 for storage of miscellaneous articles, such as, toys, diapers and other infant necessities. In one embodiment, the pocket member 23 comprises a mesh pocket to allow for expansion when larger items are placed therein. Referring to FIGS. 4 and 7, the back panel 13 also includes adjustable upper straps 25, 25' for securing of the back panel to a chair or other stationary object. The adjustable straps 25, 25' extend from the back panel 13 a sufficient length to secure the seat 11 to a chair back. The lower or bottom panel 32 also has straps 29, 29' as shown in FIG. 3 for securing the seat 11 to a chair or stationary surface or the like. The straps 25, 25' and 29, 29' have quick release buckles in order to provide easy attachment to a seat. Referring to FIG. 2, the seat member 15 and the back panel 13 also include an infant restraint 27 which aids in securing the infant within the seat in the horizontal position. The restraint 27 includes quick release buckles which are easily adjustable to accommodate infants of various sizes. The back panel 13 also includes a handle member 75 for easy portability of the seat 11 in both the horizontal and collapsed positions.

Referring to FIG. 10, the method of using the infant booster seat 11 includes securing the assembly to a chair with straps 25, 25' and 29, 29'. An infant is placed within the booster seat 11 and secured using the restraint 27. When not in use, the infant is removed from the booster seat 11, the straps 25, 25' and 29, 29' are released from the chair and the cushioned seat member 15 is directed upwardly in flush engagement with the back support 13. The front support member 43 and the mid-section support member 51 extend upwardly along with the seat member 15 and are in flush engagement and parallel alignment with the seat platform 41 and the platform base 47 as shown in FIG. 9. The sidewalls 17, 17' are oriented in a folded position surrounding the seat member 15. The side support panels 20, 20' include complementary hook-and-loop fasteners 71 and 72 for securement of the panels 20, 20' to one another when the seat 11 is in the collapsed or folded position, see FIGS. 2, 4 and 9. The booster seat assembly 11 may then be stored or carried using the handle member 75.

Referring to FIG. 8, when ready to use the booster seat 11, the sidewalls 17, 17' are disengaged and unfolded from a position overlapping one another as well as the seat member 15, to a position extending along opposite sides of the seat member 15. The front member 19 is adjusted to form the seat housing or shell 12 and the seat member 15 is then lowered into a horizontal position between and supported by the sidewalls 17, 17'. The seat member 15 including the front support member 43, the midsection support member 51 and the platform supports 41 and 47 are pushed downwardly or lowered into the shell causing vertical alignment of the midsection support member 51 and the front support member 43 providing a support base for the seat member 15. An infant may then be seated on the booster seat assembly 11 and secured using the child restraint 27.

It is therefore to be understood that while preferred embodiments are herein set forth and described, the above and other modifications may be made therein without departing from the spirit and scope of the article of manufacture as defined by the appended claims and reasonable equivalents thereof.

We claim:

1. In a foldable seat assembly having an outer shell including a back support, sidewalls and a bottom member, the combination comprising:

a cushioned seat member having at least one hinged support panel between said sidewalls and spanning a width of an underside of said seat member, said cushioned seat member resting upon said hinged support panel when in an unfolded, use position;

said cushioned seat member hingedly connected by a hinge member to said upright back support; and said sidewalls extending forwardly from said back support along opposite sides of said seat member.

2. The seat assembly according to claim 1 wherein said hinged support panel includes a plurality of support panels hingedly connected to said seat member.

3. The seat assembly according to claim 2 wherein said support panels are located between upper and lower platforms.

4. The seat assembly according to claim 3 wherein said support panels are movable between a folded position and an unfolded position extending perpendicular to said seat member.

5. The seat assembly according to claim 1 wherein said back support includes means for surrounding said seat member.

6. The seat assembly according to claim 5 wherein said surrounding means includes said sidewalls, a front wall and a bottom panel.

7. The seat assembly according to claim 5 wherein said surrounding means is dimensioned to accommodate said seat member.

8. The seat assembly according to claim 1 wherein a hinge member connects an upper rear portion of said seat member to said upright back support.

9. A portable infant booster seat comprising:

an outer shell having an upright back support, foldable sidewalls extending forwardly from and hingedly attached to opposite sides of said back support, and a flexible front wall;

a cushioned seat member including means for hingedly attaching said seat member to said back support;

means for supporting said seat member in an elevated position including support members positioned between said front wall and said back support; and means for limiting movement of said seat member between a horizontal position and an upwardly extending position into flush engagement with said back support.

10. The booster seat according to claim 9 wherein said sidewalls and said front wall include rigidifying members.

11. The booster seat according to claim 9 wherein said support members include at least one rigid platform and at least one hinged member hingedly connected to said platform.

12. The booster seat according to claim 11 wherein said at least one hinged member is hingedly attached to an underside of said seat member and said seat member rests upon said support member when in an unfolded, use position.

13. The booster seat according to claim 9 wherein a bottom member extends between lower edges of said sidewalls and said front wall.

14. The booster seat according to claim 9 wherein said seat member is upwardly extendible into parallel alignment with said back support.

15. The booster seat according to claim 9 wherein said outer shell is dimensioned to accommodate said seat member.

16. The booster seat according to claim 9 wherein said limiting means includes said hinging means and said rigid platform.

17. A collapsible booster seat assembly comprising:

an outer shell having foldable sidewall support members, a rigid back support, a front wall and a bottom member;

a cushioned seat member having means for supporting said seat member in an elevated position wherein said support means include dual platform members, said dual platform members including an upper platform attached to an underside of said cushioned seat member and a lower platform spaced apart from said upper platform, each said platform members having a front and at least two mid-section panel members inserted therebetween, wherein said front and mid-section panel members are hinged at opposite ends to said platform members; and a hinge member hingedly connecting said seat member to said back support.

18. The booster seat according to claim 17 wherein said sidewalls are connected along opposite side edges of said bottom member.

19. The booster seat according to claim 17 wherein said outer shell is dimensioned to accommodate said seat member.

20. The booster seat according to claim 17 wherein said cushioned seat member rests upon said hinged support member means when in an unfolded, use position.

21. The booster seat according to claim 17 wherein said panel members are movable between a folded position extending parallel to said platform members and an unfolded position extending perpendicular to said platform members.

22. A method of supporting an infant in a booster seat assembly, said seat assembly having a rigid, upright back support, foldable sidewalls hingedly connected to said back support, a cushioned seat member having at least one hinged support panel spanning an underside width of said seat member, said seat member hingedly connected to said back support, the method comprising the steps of:

unfolding said sidewalls from a position overlapping one another and said seat member to a position extending along opposite sides of said seat member;

adjusting said front member to form a seat housing;

lowering said seat member into a horizontal position between and supported by said sidewalls;

seating an infant on said seat member; and securing the infant to said seat member with child restraints.

23. The method according to claim 22 wherein the steps include angling said seat member support panel in relation to said seat member.

24. The method according to claim 22 wherein said seat member support panel is defined by rigid front and mid-center panels.

* * * * *